United States Patent [19]

Gurney et al.

[11] 4,404,565

[45] Sep. 13, 1983

[54] QUICKLY ERECTABLE ANTENNA SUPPORT STRUCTURE

[75] Inventors: John W. Gurney, Reston; James N. Guerci, McLean; Clifford Allison, Jr., Oakton, all of Va.

[73] Assignee: Radiation Systems Incorporated, Sterling, Va.

[21] Appl. No.: 322,601

[22] Filed: Nov. 18, 1981

[51] Int. Cl.[3] ..... H01Q 1/08

[52] U.S. Cl. ..... 343/881; 343/882

[58] Field of Search ..... 343/840, 880–882; 248/421

[56] References Cited

U.S. PATENT DOCUMENTS 4,086,599 4/1978 Vanderlinden et al. ..... 343/881

4,146,897 3/1979 Wilson et al. ..... 343/882

*Primary Examiner*—Eli Lieberman

*Assistant Examiner*—Michael C. Wimer

*Attorney, Agent, or Firm*—Pollock, Vande Sande & Priddy

[57] ABSTRACT

A compact, foldable tripod structure is self contained and mounts an antenna reflector. The structure comprises an assemblage of structural members which are long and slender, arranged to be folded into a compact configuration for storage or transport, and adapted to be rapidly unfolded at a desired site to produce an antenna support structure having great rigidity. The geometry of the structure is designed so that most components are in tension or compression, thereby resulting in a high strength/deflection-to-weight ratio which renders the structure inherently stable. Components are permanently attached to the structure and rapid erection may be completed manually.

18 Claims, 16 Drawing Figures

FIG. 1C
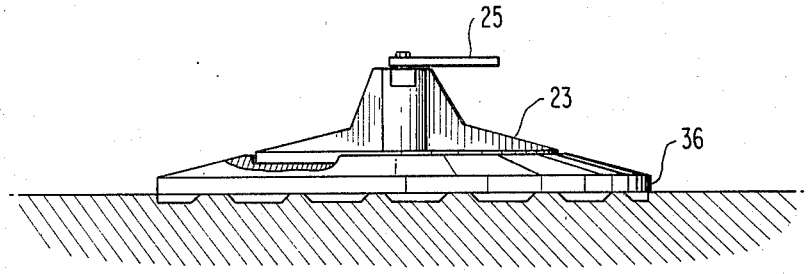
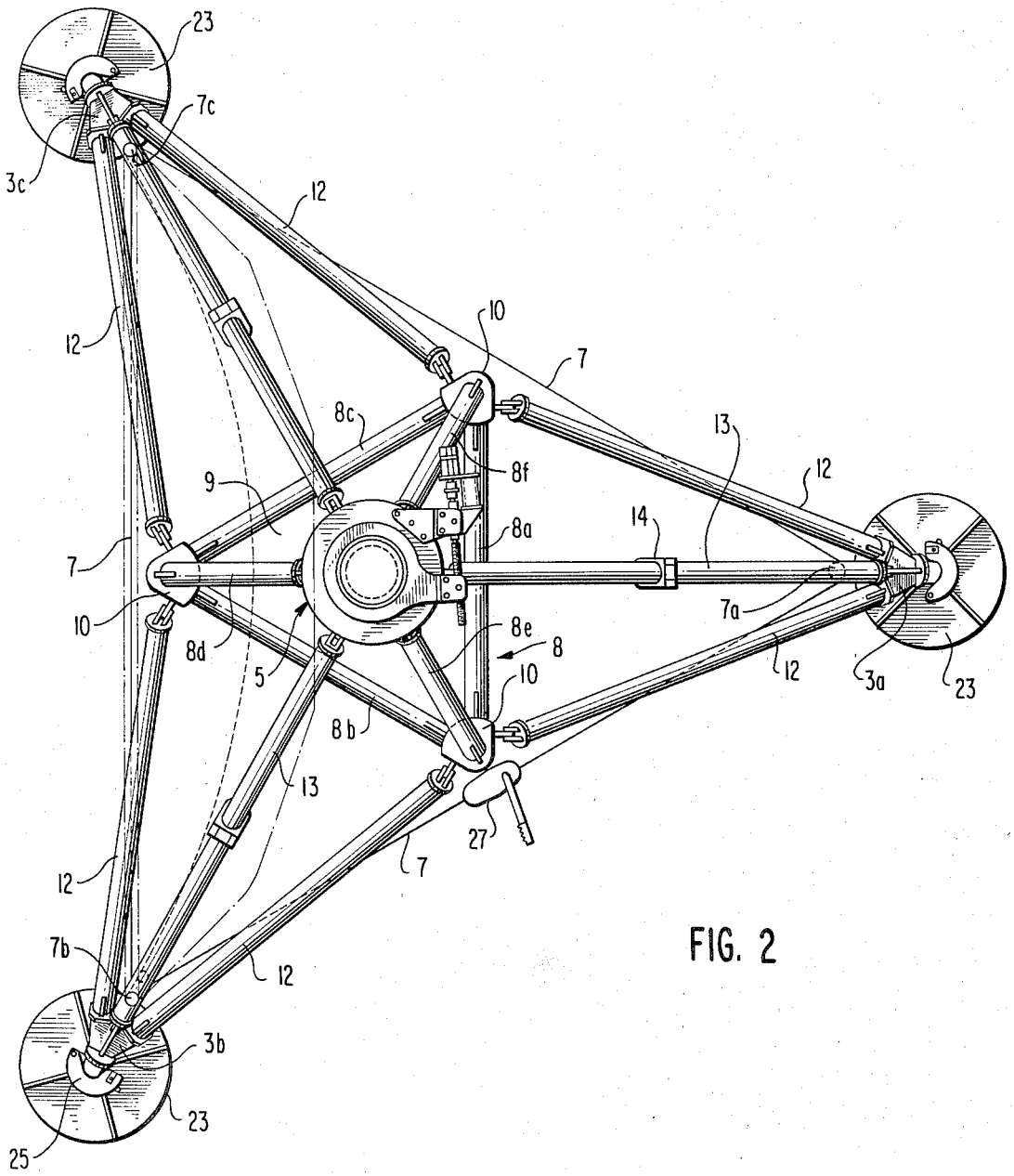
FIG. 2

FIG. 3
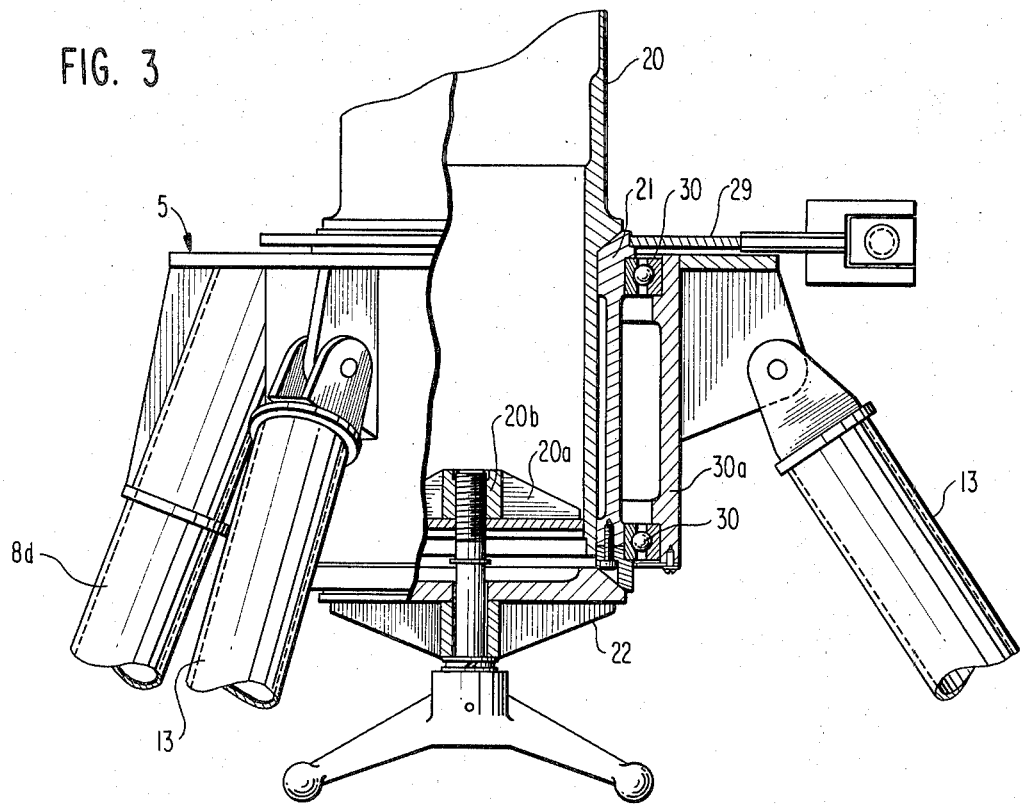
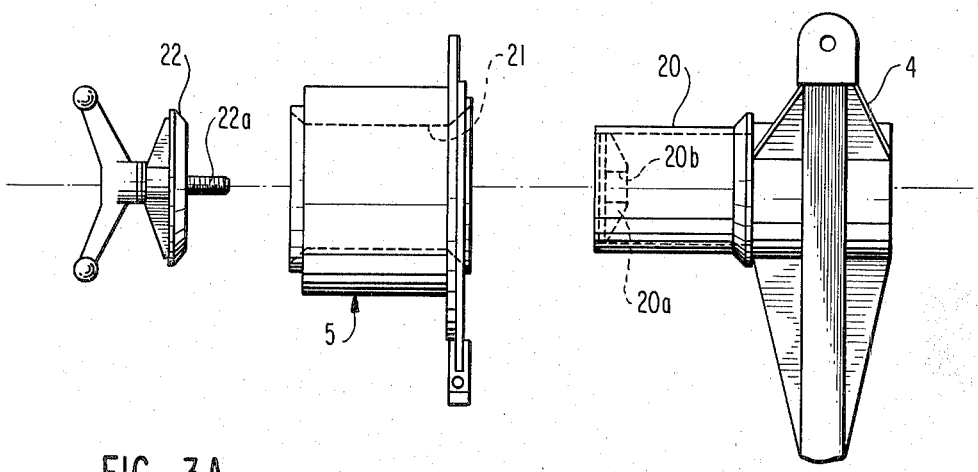
FIG. 3A

QUICKLY ERECTABLE ANTENNA SUPPORT STRUCTURE

FIELD OF THE INVENTION

The present invention relates to antennas and more particularly to a foldable support structure therefor.

BRIEF DESCRIPTION OF THE PRIOR ART

In many field operations, it is necessary to mount an antenna reflector on a support structure which is quickly erectable and collapsible. Portability is also a key factor. The prior art has included a number of support structures which require the joining of many parts together, which may result in lost parts and lengthy erection times. Further, the hardware which is often provided by prior art structures present undesirable pin/hole clearances and require the use of guy cables and attendant ground anchors.

One example of a prior art antenna structure which includes hinged and foldable legs is disclosed in U.S. Pat. No. 2,860,342, issued Nov. 11, 1958, to Edmund Warnery. Although Warnery provides a rotatable antenna that includes a platform supported by a plurality of hinged and foldable legs to facilitate transportation, there are a number of disadvantages which the present invention eliminates. The Warnery structure is erectable only by use of an electric motor as opposed to manpower alone and, further, includes a great number of parts which lend greater complexity to the structure as well as inherently lower reliability, maintainability and higher manufacturing costs.

The main structural subassemblies of Warnery are placed in neither tension or compression but instead are subjected to bending. This results in lower component strength and stiffness-to-weight ratios. In contrast to the present invention wherein the structural members of the support are long and slender (as will be described) and are loaded in pure tension or compression, the Warnery structure is characterized by the use of large trussed legs which are designed primarily for carrying moments. The large bending moment which is present at the turret of the Warnery structure due to horizontal wind load acting on the reflector is not removed by a combination of struts, as in the present invention, but instead is distributed among Warnery's trussed legs.

A further disadvantage of the prior art Warnery structure is that it does not provide for leveling of the structure to attain a vertical axis of antenna rotation. Therefore, the site on which the antenna is located must first be leveled.

The present invention obviates these disadvantages, and achieves other advantages which will become apparent from the subsequent description.

BRIEF DESCRIPTION OF THE PRESENT INVENTION

The present invention comprises a tripod antenna reflector support structure which is erectable using only manpower as opposed to the use of an electric motor which requires a source of energization that may not be available at a field location.

The support structure of the present invention comprises, at its lower end, three equilaterally spaced ground engaging membes; an apex assembly at its upper end adapted to rotatably support an azimuth frame on which an antenna reflector is mounted; a triangular frame located below the apex assembly and above the ground engaging members; and a plurality of long, slender tubular legs which extend respectively between the ground engaging members, the apex assembly, and the intermediate triangular frame. Each ground engaging member has three such legs upstanding therefrom, i.e., two legs which extend from the ground engaging member to opposite ends of an associated side of the said triangular frame, respectively, and a third, longer, foldable leg which extends from the ground engaging member to the apex assembly. These several legs are so articulated relative to the portions of the support structure with which they are associated that the overall structure may be folded into a compact configuration for storage and/or transport to a desired site, and rapidly erected when desired.

The invention is configured with a relatively few number of parts which results in higher reliability, better maintainability and lower manufacturing costs. Further, the use of both folding and nonfolding leg members results in a number of advantages, i.e., joints must be latched on only the foldable legs; the structural members may be placed primarily in tension or compression as opposed to bending, resulting in higher strength and stiffness-to-weight ratios; and the nonfoldable legs can support compressive loads which places a lower emphasis on cables and/or tie rods to interconnect the footpads of the structure whereby the present invention permits more rapid and less critical erections since the cable/tie rod preloads to not have to be as closely monitored as in the case of many prior art approaches.

The present invention also permits the incorporation of turnbuckle devices in various of the legs for use in leveling the structure on uneven terrain. In addition, a tray is integrally mounted to the structure, which may be loaded with rocks, sandbags, or other convenient dead weight thereby obviating the necessity for anchors, under most conditions, which may be difficult to install on certain types of terrain. The structure of the present invention is manually erectable and eliminates the need for a person to climb the structure during erection or to perform antenna azimuth and elevation adjustments after erection as is required by many prior art structures.

The above-mentioned objects and advantages of the present invention will be more clearly understood when considered in conjunction with the accompanying drawings, in which:

BRIEF DESCRIPTION OF THE FIGURES

FIG. 1C is an elevational view of a footpad and extension as employed in the present invention.

FIG. 2 is a top plan view of the structure of the present invention.

FIG. 3 is a partial sectional view of an apex assembly included in the present invention.

FIG. 3A is an assembly view of an azimuth frame and apex assembly as included in the present invention.

DETAILED DESCRIPTION OF THE INVENTION

An antenna support structure constructed in accordance with the present invention is characterized by its use of a plurality of members that can be rapidly unfolded to produce a tripod structure having great rigidity. The geometry of the design is such that almost all members are in tension/compression, thereby resulting in a high strength/deflection-to-weight ratio. Since most components are permanently attached to the structure, erection can be accomplished very rapidly by unfolding the legs of the structure, and the permanent installation of most components results in lower construction costs and allows less clearance between mating pins and holes. The structure is inherently stable and self-anchoring in low winds, and additional anchoring in higher winds can be provided by the addition of up to three ground anchors and/or dead weight to the structure. The entire erection is accomplished with a minimum use of tools and manpower.

The support structure comprises, at its lower end, three equilaterally spaced ground engaging members comprising, for example, three plates to which footpads may be connected; an apex assembly at its upper end adapted to rotatably support an azimuth frame on which an antenna reflector is mounted; a triangular space frame located below the apex assembly and above the ground engaging members; and a plurality of tubular legs which extend respectively between the ground engaging members, the apex assembly, and the intermediate space frame. Each ground engaging member has three such legs upstanding therefrom, i.e., two legs which extend from the ground engaging member to opposite ends of an associated side of the triangular base of the space frame, respectively, and a third, longer, foldable leg which extends from each ground engaging member respectively to the apex assembly. The space frame itself includes three further legs which extend from the apices of the triangular base of the space frame to the apex assembly. Various of the legs of the structure are so articulated relative to the portions of the support structure with which they are associated that the overall structure may be folded into a compact configuration for storage and/or transport to a desired site, and then rapidly unfolded to erect the antenna at said site. The structure includes, moreover, manually operable jacks as well as an erection cable assembly, for use in erecting the support structure.

Figures 1, 1A, 1B:
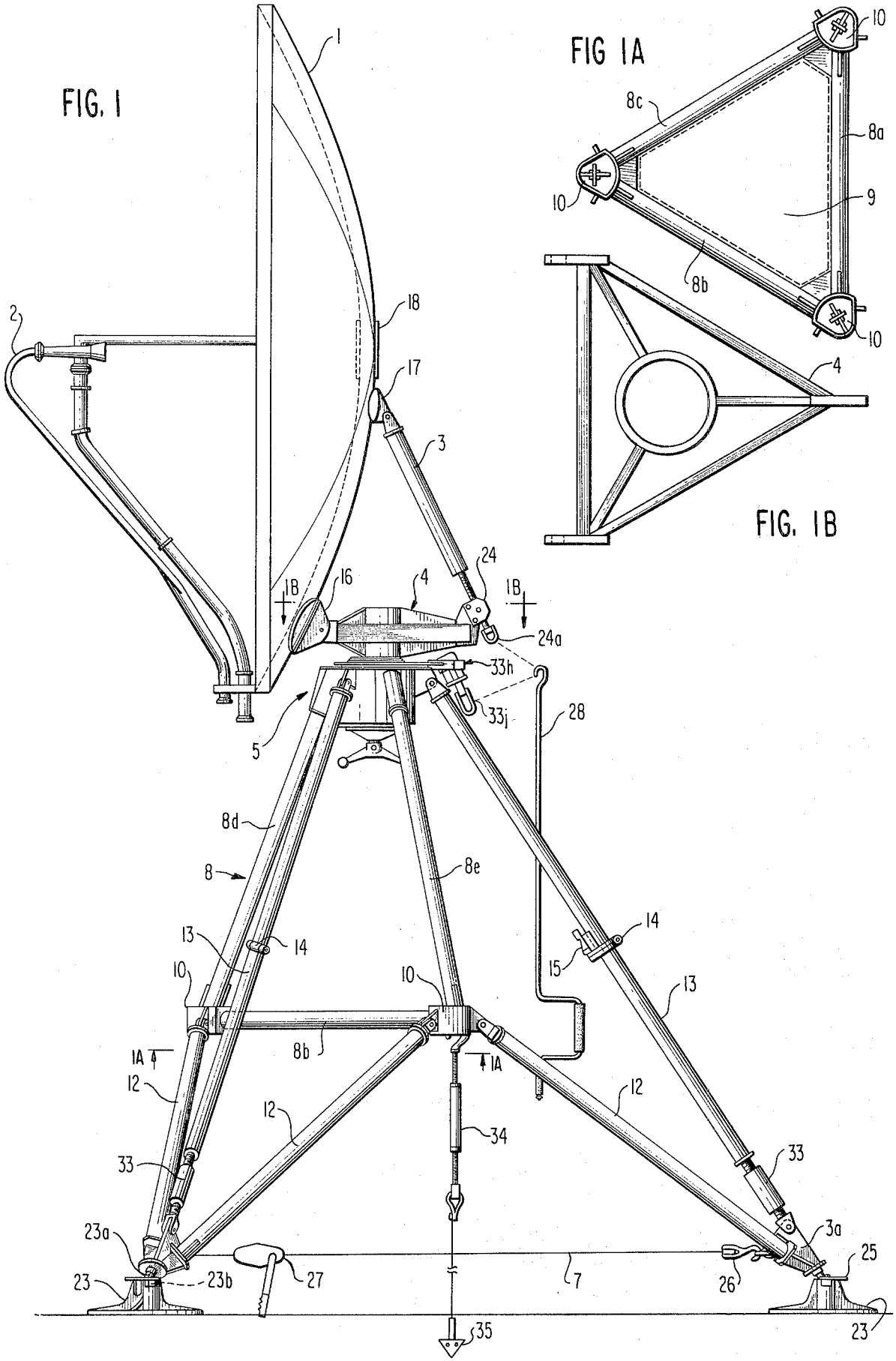
FIG. 1 is a side elevational view of an erected antenna employing the present invention.
FIG. 1A is a plan view taken along a plane passing through section line 1A—1A of FIG. 1.
FIG. 1B is a plan view taken along a plane passing through section line 1B—1B of FIG. 1.

Referring to the figures and more particularly to FIG. 1, a parabolic reflector 1 is seen to be mounted in an upright position with a feed 2 properly mounted to the parabolic reflector. An elevation jack 3 is pivotally secured at an upper end thereof to an elevation pivot 17 and is removably connected to a clevis 24 at a lower end thereof. The clevis 24 is secured to an azimuth frame 4, which is shown in greater detail in FIG. 1B. The azimuth frame 4 is mounted to an apex assembly, generally indicated by reference number 5, by means of a coupling, to be discussed in greater detail in connection with FIGS. 3 and 3A.

Figure 6:
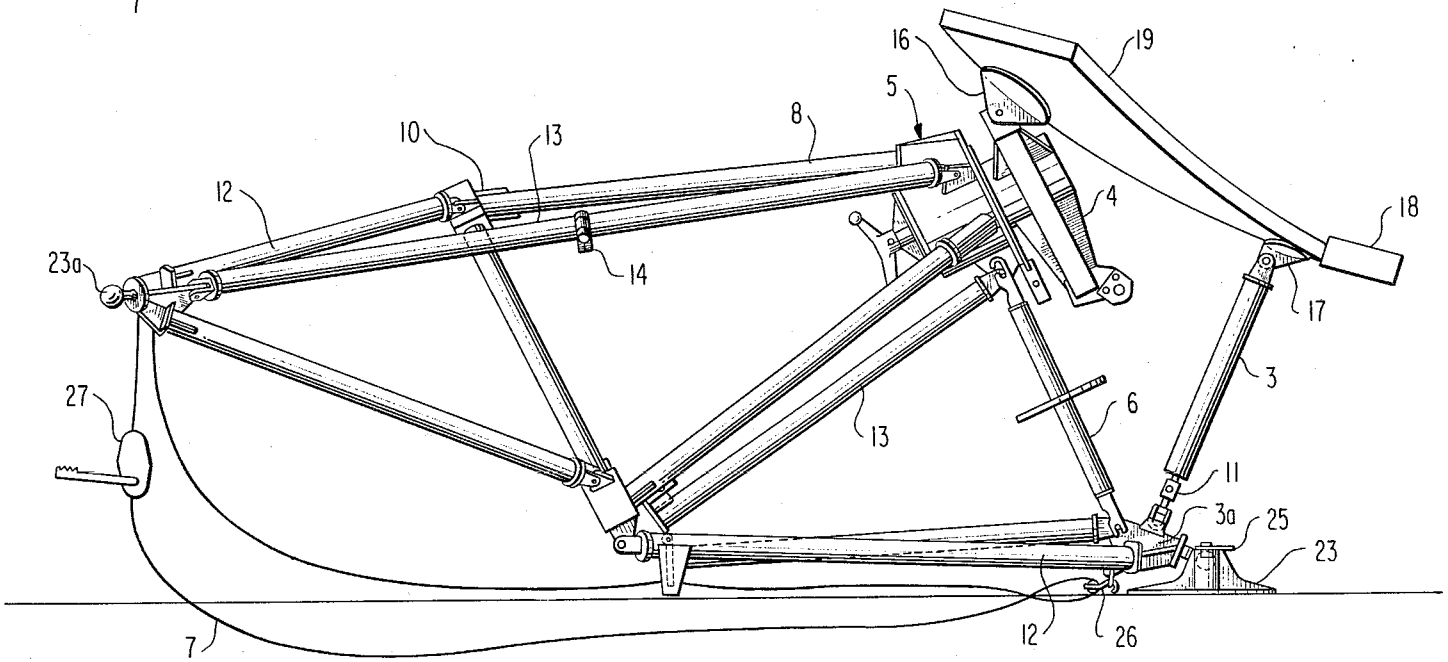
FIG. 6 is a perspective view of the present invention illustrating the initial position of the present structure, prior to being erected.

Referring to FIG. 6, the support structure is seen to be reclining in preparation for erection. The elevation jack 3 remains pivotally connected to elevation pivot 17 but the lower end of the jack bears against an edge of a plate 3*a* via a trunnion block 11, disposed at the lower end portion of elevation jack 3. During initial set-up of the support structure, as shown in FIG. 6, the lower end of elevation jack 3 abuts plate 3*a*, but during the terminal phases of erection, as shown in FIG. 7, the lower end of elevation jack 3 is connected to clevis 24 so that the elevation of the parabolic reflector 1 may be adjusted.

Figure 7:
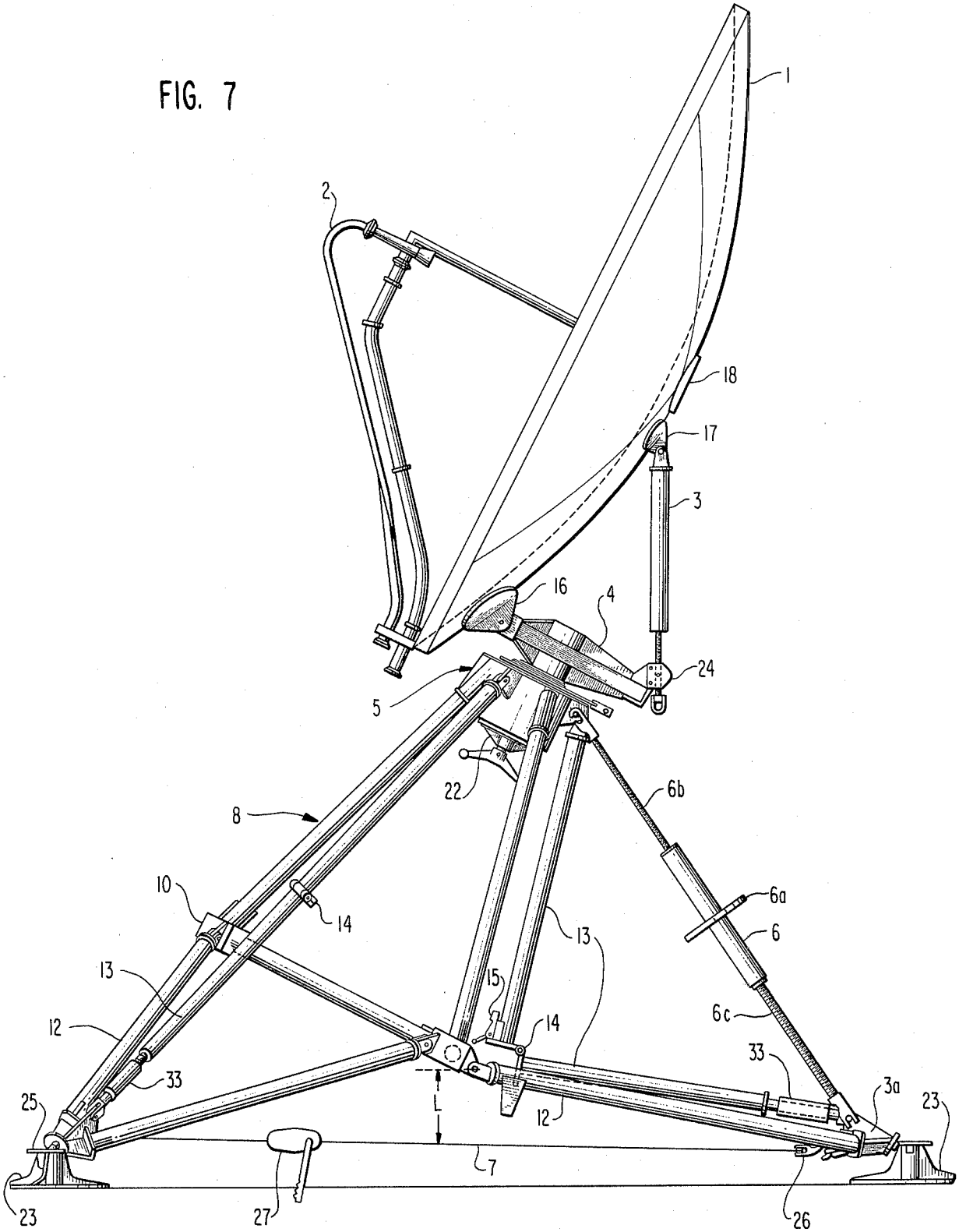
FIG. 7 is a perspective view of the invention shown in a near erected condition.

Erection jack 6, shown in FIGS. 6 and 7, is basically a turnbuckle having a wheel 6*a* which accomplishes displacement of the solid threaded member 6*b* into telescoping relationship with the lower externally threaded tubular member 6*c*. As the two threaded members 6*b*, 6*c* are retracted into the body of the turnbuckle, the solid member 6*b* telescopes inside the tubular member 6*c*. This telescoping feature permits a larger ratio of extended length-to-retracted length than is possible with a conventional turnbuckle. The erection jack 6 is shown in FIG. 6 during the initial set-up phase for the antenna structure wherein it is shown releasably connected between apex assembly 5 and plate 3*a*. As erection proceeds, and as will be apparent from a comparison of FIGS. 6 and 7, the threaded members 6*b* and 6*c* expand outwardly causing the apex assembly 5 to be displaced upwardly.

The structure further includes a cable 7 which has a hook 26 at a first end thereof that engages plate 3*a*. The cable 7 is looped about points 7*a*, 7*b* and 7*c* (FIG. 2) so that upon shortening of the resultant triangularly shaped cable 7, by means of a tensioning device 27, the structure will rise as shown in FIG. 7. The tensioning device 27 may be any appropriate cable length adjusting mechanism, typically ratchet driven.

The central portion of the structure includes a space frame which is generally indicated by reference numeral 8 in FIGS. 1 and 2. The frame 8 consists of tubular members made from high strength/low weight materials such as aluminum alloy or graphite-epoxy composite, and comprises a triangular array of fixed tubular sections 8*a*, 8*b* and 8*c* (see FIG. 1A) forming the base of the space frame 8 and having corner members 10 at each triangular apex of the interconnected tubular members. Corner members 10 may be constructed of cast or welded aluminum alloy. Space frame 8 further includes tubular members 8*d*, 8*e* and 8*f* which are connected at their lower ends to respective corner members 10, while their upper ends are secured within apex assembly 5 (see also FIG. 3 in this respect). The appearance of the space frame 8 from an elevational view is shown in FIG. 1.

A triangular tray 9 is positioned at the base of space frame 8 between the tubular sections 8*a*, 8*b* and 8*c* as clearly shown in FIGS. 1A and 2. The purpose of this tray 9 is to permit the loading thereof with rocks, sandbags or the like in order to increase the stability of the elevated structure in high wind conditions.

As seen in FIGS. 1 and 2, attached to each of the footpad plates 3*a*, 3*b* and 3*c* are the lower ends of the two nonfoldable tubular legs 12. The upper ends of the tubular legs 12 are pivotally connected to respective corner members 10 on the base of space frame 8. A further plurality of elongated tubular legs 13, each of which is foldable, extends upwardly from the footpad plates. More particularly, referring to FIGS. 1 and 2, it will be seen that the lower end of each folding leg 13 is pivotally secured to a corresponding footpad plate 3*a*, 3*b* and 3*c* while the upper end of each leg 13 is pivotally secured to apex assembly 5 (see FIGS. 1 and 3). A plate hinge 14 is positioned at an intermediate point along the length of each folding leg 13, and a hinge latch 15 secures the hinge 14 when the structure is erected. The legs 12, 13 are similar in construction to space frame 8, and consist of straight tubular members which are connected with socket-type joints to end fittings (i.e., clevises, plate hinges) made from aluminum alloy castings or weldments.

Referring to FIG. 1 an elevation clevis 16 is permanently mounted to the lower reflector quadrant 19 (FIG. 6) of parabolic reflector 1 and pivotally secured to the azimuth frame 4 by an appropriate pivot pin. The elevation pivot 17 is also permanently secured to the lower reflector quadrant 19. A hub structure 18 appropriately couples the remaining quadrants to one another until a parabolic reflector 1, as shown in FIG. 1, is completed. The reflector is preferably completely assembled before the support structure is fully elevated, as shown in FIG. 7 and as will be described in further detail hereinafter.

Figure 5A:
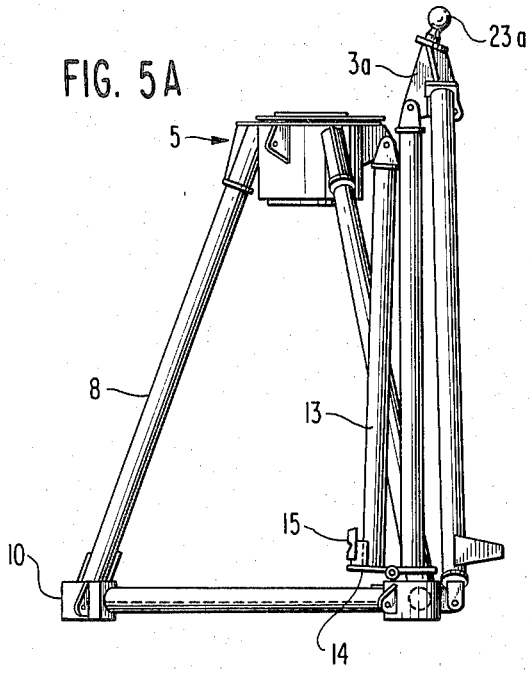
FIG. 5A is a partial elevational view of the present support structure when in a collapsed condition.
Figure 5B:
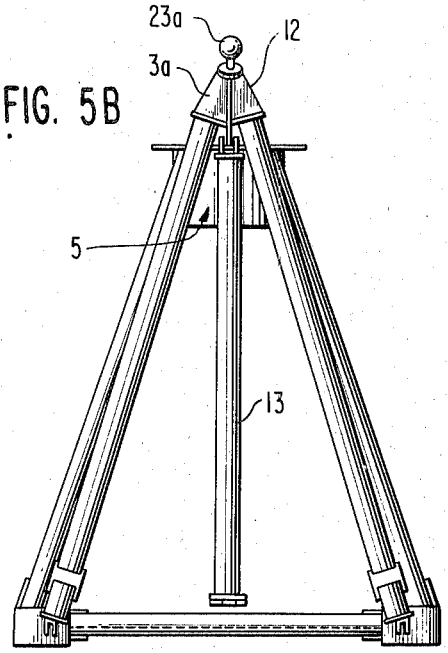
FIG. 5B is a view similar to that of FIG. 5A when the structure is rotated 90 degrees.
Figure 5C:
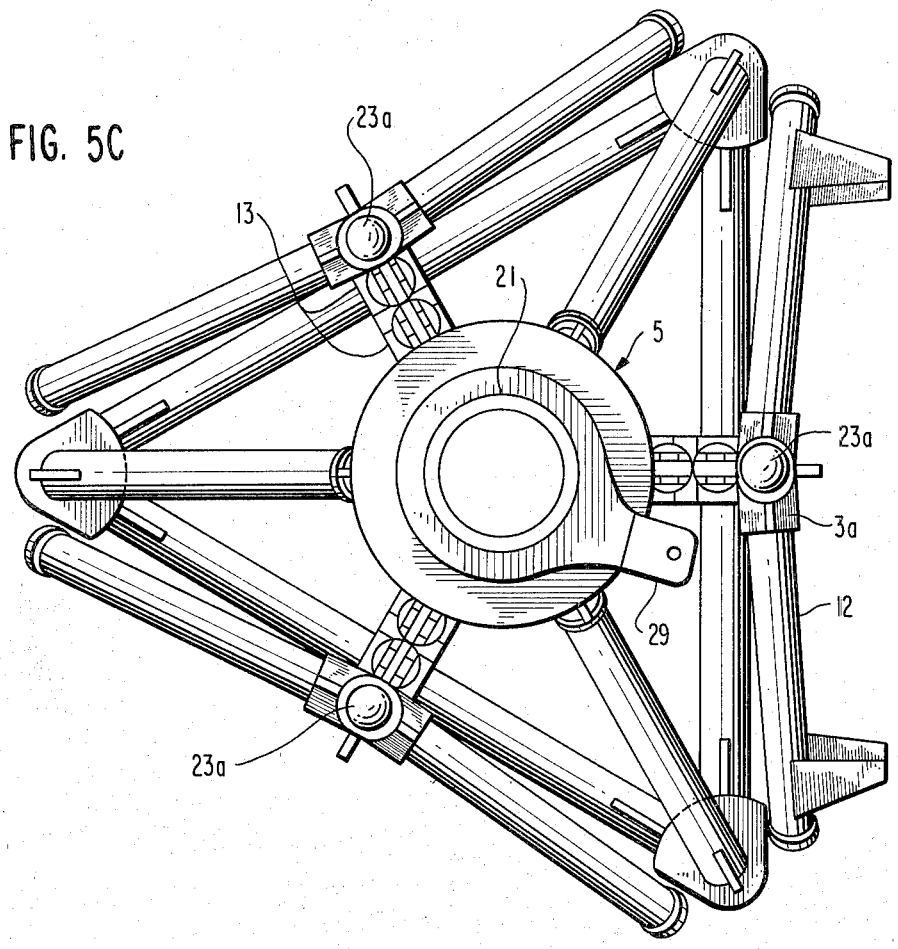
FIG. 5C is a top plan view of the structure shown in FIGS. 5A and 5B.
Figure 7A:
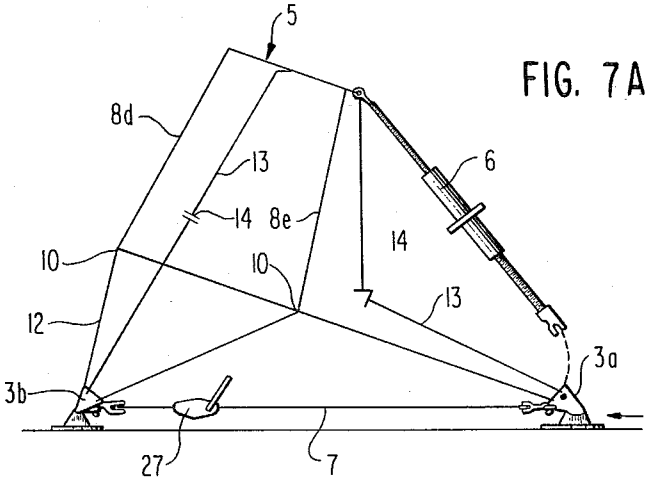
FIG. 7A is a simplified schematic illustrating the connection points between the various legs of the structure.

FIGS. 5A, 5B and 5C illustrate the support structure in its completely folded and compact configuration prior to assembly and erection in the field. In this state the parabolic reflector 1 and azimuth frame 4 (FIG. 1) have been removed for storage. The resulting space frame 8 shown in these figures includes a number of ball connectors 23*a* which will be coupled with sockets 23*b* formed in footpads 23 (FIG. 1) so that ball and socket footpads result which enable leveling of the erected structure on uneven terrain. FIGS. 1, 2 and 1C illustrate a latch 25 which secures the ball socket connection of each webbed footpad 23 to the plates 3*a*, 3*b* and 3*c*. Further, FIG. 1C illustrates the inclusion of a removable footpad extension 36, made of a suitably cleated material, and having a circular depression in its upper surface in which a footpad 23 may be seated. Extension 36 may be optionally employed for increasing the load bearing area required by soft soil or high wind conditions.

In order to understand the coupling of the azimuth frame 4 and apex assembly 5 on the space frame 8, attention is directed to FIGS. 3 and 3A. The azimuth frame 4 is a triangular aluminum weldment to which the lower reflector quadrant 19 and elevation jack 3 are attached, and the azimuth frame 4 is, in turn, attached to the apex assembly 5 with a quick connect coupling. More particularly, azimuth frame 4 includes a stem 20 with an internal boss 20*a* which is centrally threaded at 20*b*. The apex assembly 5, the casing of which may be an aluminum alloy casting or weldment, includes a hollow shaft 21 with a beveled entrance for readily admitting the stem 20 of azimuth frame 4. The opposite end of the hollow shaft 21 of apex assembly 5 also includes a beveled entrance to admit clamping cap 22 having a threaded stud 22*a* adapted to engage the threaded portion 20*b* of boss 20*a* in azimuth frame 4. By tightening the threaded stud 22*a*, the azimuth frame 4 may be quickly connected to the apex assembly 5. The tapered seats which interface stem 20 and clamping cap 22 provide wedging action which secures the coupling from radial and axial deflections.

Referring once again to FIG. 3, the apex assembly 5 will be seen to include bearings 30 which permit rotation of hollow shaft 21, relative to the apex assembly housing 30*a*. Thus, azimuth frame 4 is rotatably mounted within apex assembly 5 which permits the azimuth frame to undergo horizontal rotation necessary for making azimuth adjustments with the parabolic reflector 1 (FIG. 1).

Figure 4:
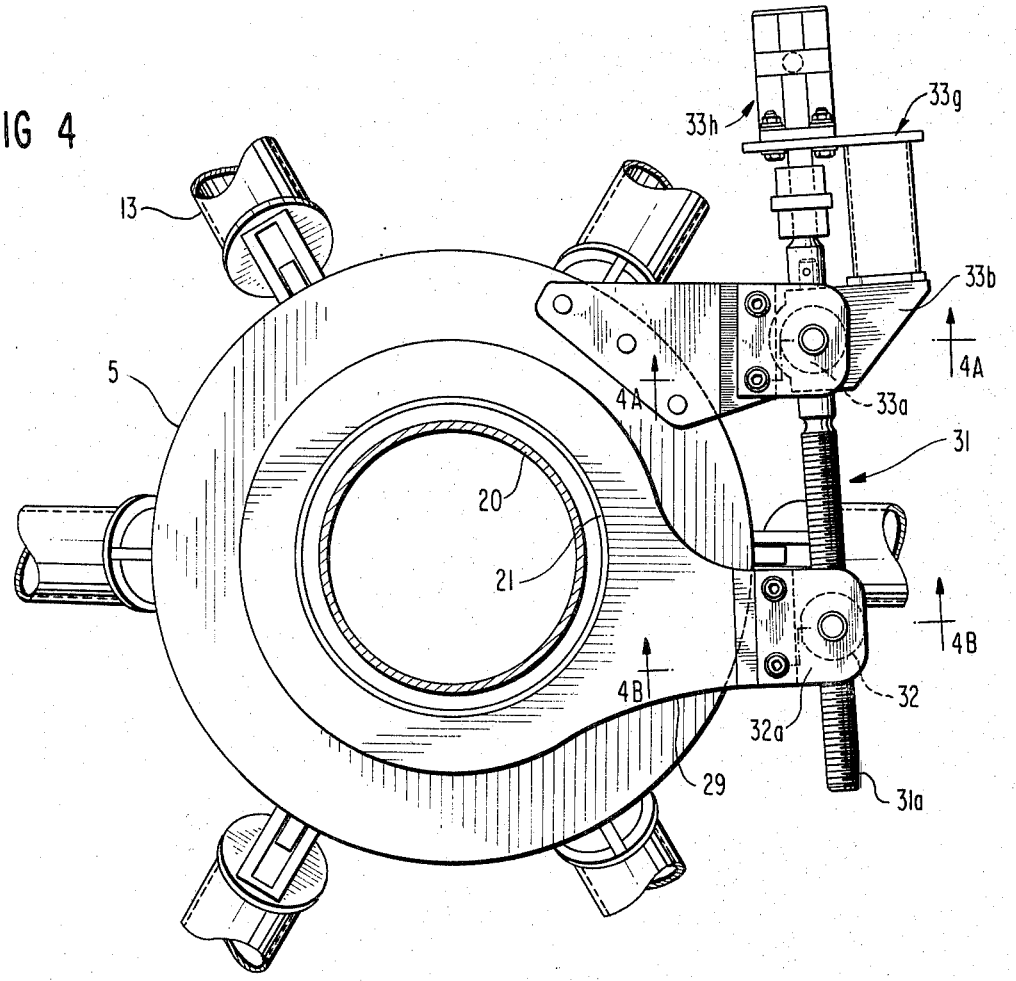
FIG. 4 is a top plan view of an azimuth adjustment mechanism as included in the present invention.
Figure 4A:
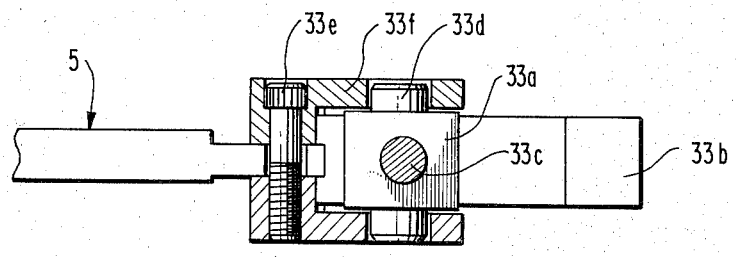
FIG. 4A is a partial sectional view taken along a plane passing through section line 4A—4A of FIG. 4.
Figure 4B:
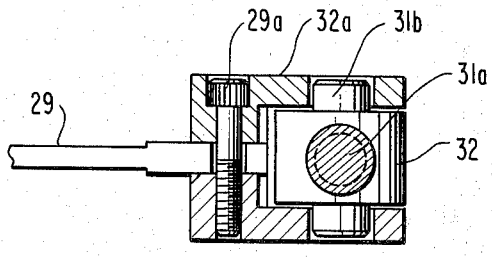
FIG. 4B is a partial sectional view taken along a plane passing through section line 4B—4B of FIG. 4.

In order to accomplish this adjustment a bell crank 29 is employed as shown in FIG. 4A, axially mounted to the stem 20. An azimuth adjustment mechanism is generally indicated by reference numeral 31. A traveling nut 32 is secured within clevis 32*a* (FIG. 4B) of the bell crank 29. A horizontal screw jack 31*a* passes through the traveling nut 32, and as the screw jack is turned the traveling nut 32 forces the bell crank 29 to rotate in one sense or the other. FIG. 4B illustrates the securement of bell crank 29 to clevis 32*a* by threaded fasteners 29*a*. Traveling nut 32 is positioned within clevis 32*a* by means of a trunnion 31*b*.

FIGS. 4 and 4A illustrate the retention of the rearward end portion of screw jack 31*a*. As will be seen in detail in FIG. 4A, a clevis 33*f* is secured to apex assembly 5 by means of threaded fasteners 33*e*. The rearward end portion of screw jack 31*a* is indicated in FIG. 4A by reference numeral 33*c* and it is seen to be secured within circular member 33*a* which is pivotally retained by means of trunnion 33*d*, in clevis 33*f*. A flange 33*b* is secured to clevis 33*f* and, as seen in FIG. 4, angle bracket assembly 33*g* mounts a right angle drive 33*h* terminating downwardly in a shackle 33*j* (FIG. 1). A hand crank 28 is easily attached to the shackle 33*j* and upon manual rotation of the crank the right angle drive 33*h* transmits motion to the screw jack 31*a*, which in turn imparts rotation to bell crank 29. As illustrated in FIG. 1, azimuth frame 4 mounts the parabolic reflector 1 via elevation clevis 16 and also elevation pivot 17, via elevation jack 3. Thus, any rotation of azimuth frame 4 will be transmitted to the parabolic reflector 1.

Referring to FIG. 1, it will be seen that each folding leg 13 is provided with a leveling turnbuckle 33. These turnbuckles enable independent lengthening or shortening of each folding leg 13 which is desirable in order to properly level the structure upon erection.

A turnbuckle 34 may be connected between each corner member 10, via an integral hook and shackle, and a ground anchor 35. Anchoring is not necessary under low wind conditions, but is utilized in the event of relatively high wind conditions.

In order to erect the structure of the present invention, one begins with the fully loaded space frame 8 as shown in FIGS. 5A, 5B and 5C. A footpad 23 is then attached to the rear ball connector 23*a* shown in these figures. Next, the space frame 8 is lowered to a horizontal position, as shown in FIG. 6, while resting on the installed footpad 23. With continuing reference to FIG. 6, the erection jack 6, which is initially fully retracted, is installed between the illustrated plate 3*a* and the apex assembly 5 to prop up the antenna support structure while the azimuth frame 4 and reflector quadrants are being installed; and also functions to raise the support structure up to a level where erection cable 7 can take over the erecting function.

In the position shown in FIG. 7, the erection jack 6 forms a hypotenuse or connecting member between the hinged sections of folding leg 13. The azimuth frame 4 is attached as explained in connection with FIG. 3A. Now referring to FIG. 6, the lower reflector quadrant 19, which is permanently connected to the elevation pivot 17 and the elevation clevis 16, is then moved to a horizontal position by using elevation jack 3. The remaining reflector quadrants are connected to hub 18, and then feed 2 is connected to the completed parabolic reflector 1. These steps are all done by a person standing on the ground since, at this time, the hub 18 and the reflector quadrants supported thereby are relatively close to the ground. The reflector quadrants have monocoque construction using aluminum alloy material for light weight and high rigidity. The quadrants are rapidly fastened together with quick acting latches that eliminate the use of hand tools.

Referring to FIG. 7, the lower end of elevation jack 3 is then removed from engagement with plate **3*a* and instead connected to clevis 24. The remaining two footpads 23 are attached to the structure. The erection jack 6 is then operated so that the tubular members 6*b* and 6*c* are extended thereby raising the structure to a partially elevated position. Next, erection cable 7 with attached tensioning device 27 are installed. Erection jack 6 is then further operated until it reaches the end of its travel as seen in FIG. 7. The structure is thereafter continually raised by increasing the tension on erection cable 7 by means of the tensioning device 27. When the structure assumes the fully erected position shown in FIG. 1, the plate hinges 14 on folding legs 13 are secured by their respective hinge latches 15 to lock legs 13 into their straight or unfolded positions, after which erection cable 7 is given a final tensioning adjustment. The leveling turnbuckles 33 on each of the folding legs 13 are then adjusted for proper level with the terrain and thereafter an elongated hand crank 28 is inserted, by a person standing on the ground, into shackle 24*a* and operated to adjust elevation jack 3 until the parabolic reflector 1 is situated for correct elevation. Next, hand crank 28 is positioned in shackle 33*j*, and the crank is again operated until the parabolic reflector 1** assumes the proper azimuth.

In order to increase the stability and wind deflection characteristics, tray 9 (FIG. 1A) may be loaded with dead weight and, if necessary, one or more of the illustrated ground anchors 35 may be installed and tightened into place with turnbuckles 34. Ordinarily, when anchors 35 are used, three such anchors are provided, i.e., one at each corner of the structure.

In a typical embodiment of the invention, the several legs of the support structure are fabricated of 2½" O.D. by 0.125" wall tubing, the reflector 1 has a diameter of 6', the feed 2 stands 11' off the ground and the tray 9 is approximately 3½' off the ground when the support structure is fully erected, the footpad extensions have an O.D. of 2', and the centers of the footpads are located on a circle having a diameter of approximately 128". The frame can be fabricated of either metallic or composite (e.g., carbon epoxy) structures.

It should be understood that the invention is not limited to the exact details of construction shown and described herein for obvious modifications will occur to persons skilled in the art.

We claim:

1. A collapsible support structure comprising:

an apex assembly;

at least three corner members positioned in co-planar relation with each other and at a preselected distance from the apex assembly;

a first plurality of frame members connected at opposite ends thereof between the apex assembly and the corner members;

at least three footpad means adapted to rest upon a surface;

a plurality of folding frame members pivotally connected between the apex assembly and respective footpad means;

a second plurality of frame members, each footpad means connecting first ends of at least two such frame members while opposite ends thereof are pivotally connected to the adjacent corner members in closest proximity to the footpad means; and a tensioned cable engaging a point in proximity to each footpad means for maintaining the structure erect thus minimizing bending forces on the frame members.

2. The support structure set forth in claim 1 wherein the structure includes latch means integrally mounted to the folding frame members for securing these members in fastened positions when the structure is erect.

3. The structure set forth in claim 1 wherein each footpad means includes a ball and socket coupling for accommodating irregularities in the surface upon which the structure rests.

4. The structure set forth in claim 1 wherein the folding frame members include extensible means therein for individually varying the member length thus permitting the structure to be erected in a level position on uneven terrain.

5. The structure set forth in claim 1 together with extensible means connectable between the footpad means and the apex assembly for straightening a folding frame member and raising the structure from a collapsed position.

6. The structure set forth in claim 1 together with extensible means integrally connected at a first end thereof to at least one corner member and means attached to the opposite end thereof for anchoring the structure.

7. The structure set forth in claim 1 together with third frame members connected between the corner members for completing a rigid frame section with the apex assembly and the first frame members.

8. The structure set forth in claim 1 together with tray means secured between the corner members upon which weighted objects may be placed for increasing the stability of the structure.

9. The structure set forth in claim 2 wherein the footpad means includes a ball and socket coupling for accmmodating irregularities in the surface upon which the structure rests and further wherein the folding frame members include extensible means therein for individually varying the member length thus permitting the structure to be erected in a level position.

10. The subject matter set forth in claim 9 together with second extensible means connectable between a preselected footpad means and the apex assembly for straightening a folding frame member and raising the structure from a collapsed position, together with third extensible means integrally connected at one end thereof to at least one corner member and means attached to the opposite end thereof for anchoring the structure.

11. The subject matter set forth in claim 10 together with third frame members connected between the corner members for completing a rigid frame section with the apex assembly and the first frame members, together with tray means secured between the corner members upon which weighted objects may be placed for increasing the stability of the structure.

12. A collapsible support for an antenna reflector comprising:

an apex assembly;

at least three corner members positioned in substantially co-planar relation with each other and at a preselected distance from the apex assembly;

a first plurality of frame members connected at opposite ends thereof between the apex assembly and the corner members;

at least three ground engaging members;

a plurality of folding frame members pivotally connected between the apex assembly and respective ground engaging members;

a second plurality of frame members, each ground engaging member connecting first ends of at least two such frame members while opposite ends thereof are pivotally connected to the adjacent corner members in closest proximity to the ground engaging member;

a tensioned cable engaging a point in proximity to each ground engaging member for maintaining the support erect thus minimizing bending forces on the frame members; and means removably mounted to the apex assembly for supporting a parabolic reflector.

13. The support set forth in claim 12 together with drive means for rotating the mounting means thus adjusting the azimuth of the reflector.

14. The support set forth in claim 13 together with extensible means connected between a reflector and the mounting means for adjusting the elevation of the reflector.

15. The support set forth in claim 14 together with:

latch means integrally mounted to the folding frame members for securing these members in fastened positions when the support is erect;

each ground engaging member comprising footpad means including a ball and socket coupling for accommodating irregularities in the surface upon which the support rests;

the folding frame members including second extensible means therein for individually varying the member length thus permitting the support to be erected in a level position;

third extensible means connectable between a preselected footpad means and the apex assembly for straightening a folding frame member and raising the support from a collapsed position;

fourth extensible means integrally connected at one end thereof to at least one corner member and means attached to the opposite end thereof for anchoring the support;

third frame members connected between the corner members for completing a rigid frame section with the apex assembly and the first frame members; and tray means secured between the corner members upon which weighted objects may be placed for increasing the stability of the structure.

16. A collapsible support for an antenna reflector comprising a tubular space frame having a triangular base; an apex assembly mounted on the upper end of said space frame; three ground engaging members spaced from one another in a triangular array below the base of said space frame; and a plurality of straight tubular legs extending from said ground engaging members, said legs including first and second legs extending respectively from each of said ground engaging members to opposing ends of one of the sides of said triangular base and pivotally attached thereto, and a third leg extending from said ground engaging member to said apex assembly and pivotally attached thereto, each of said first and second legs being nonfoldable between the opposing ends thereof, and each of said third legs being foldable between the opposing ends thereof.

17. The collapsible support of claim 16 wherein each of said ground engaging means comprises a footpad adapted to rest on a ground surface.

18. The collapsible support of claim 16 wherein at least some of said legs include adjustment means for selectively changing the effective length of said leg.

* * * * *